US005423536A

United States Patent [19]

Brown

[11] Patent Number: 5,423,536

[45] Date of Patent: Jun. 13, 1995

[54] AN ANTISKID FRUSTOCONICAL RIM FOR RETROFITTING ON A BUTT OF A GOLF CLUB OR OTHER DEVICE THAT IS SWUNG

[76] Inventor: Randall H. Brown, 12 Frandon Dr., Danbury, Conn. 06811

[21] Appl. No.: 177,173

[22] Filed: Jan. 4, 1994

[51] Int. Cl.[6] ..... A63B 53/14

[52] U.S. Cl. ..... 273/81 D

[58] Field of Search ..... 273/81 R, 81 D

[56] References Cited

U.S. PATENT DOCUMENTS

| | | | |
|---|---|---|---|
| D. 164,241 | 8/1951 | Karns | 273/81 R X |
| 1,213,014 | 1/1917 | Rees | 273/81 R |
| 1,213,370 | 1/1917 | Hillerich | 273/81 R |
| 1,777,822 | 10/1930 | Barrett | 273/81 R |
| 2,091,458 | 8/1937 | Sleight | 273/81 R |
| 2,459,996 | 1/1949 | Duncan | 273/81 R |
| 2,583,198 | 1/1952 | Axton, Jr. | 273/81 R X |
| 3,245,686 | 4/1966 | Hartmeister | 273/81 R |
| 3,376,038 | 4/1968 | Henry | 273/81 R |
| 3,606,326 | 9/1971 | Sparks et al. | 273/81 R |
| 3,837,647 | 9/1974 | Jacques | 273/81 R |
| 4,653,754 | 3/1987 | Cross | 273/72 R |
| 4,709,925 | 12/1987 | Gatlin | 273/29 A |
| 4,981,297 | 1/1991 | Foster | 273/81 D |

*Primary Examiner*—William H. Grieb
*Attorney, Agent, or Firm*—Ware, Fressola, Van der Sluys & Adolphson

[57] ABSTRACT

Anti-skid golfing apparatus for a handle of a golf club for preventing it from sliding off a golfer's hand when the golf club is swung. The anti-skid apparatus is made of a pliable anti-skid material, and has an outer frustoconical anti-skid surface for frictionally engaging the golfer's hand and preventing the golf club from sliding off the golfer's hand when the golf club is swung.

11 Claims, 2 Drawing Sheets

AN ANTISKID FRUSTOCONICAL RIM FOR RETROFITTING ON A BUTT OF A GOLF CLUB OR OTHER DEVICE THAT IS SWUNG

The present invention generally relates to a golf club, and more particularly to a golf club having a handle with a safety device thereon to restrain the club against centrifugal force during a high velocity swing. In order to avoid the accidental release of a golf club during a vigorous driving swing, every golfer must tighten his grip on the club handle while swinging. The need for a tightly clenched grip unavoidably distracts the golfer from concentration on the aim, force and precision of the swing, adversely affecting the golfer's performance. The invention significantly reduces such distractions.

BACKGROUND OF THE INVENTION

There are many known handle grip devices for sports clubs, mallets, and bats, and particularly golf clubs. For instance, Jacques (U.S. Pat. No. 3,837,647) shows a golf club handle grip having a hand grip member 13 with a knob-like enlargement 22 and a fillet portion 23 as shown in FIGS. 1–3, that is not economical or readily added to retro-fit a normal club. Sleight (U.S. Pat. No. 2,091,458) shows an adjustable handgrip having an end member 10 with internal suction cups making it readily detachable, not permanently mounted. Duncan (U.S. Pat. No. 2,459,996) shows a golf club grip having a golf club sleeve 10 with a smoothly rounded end cap 14 that is slightly enlarged, but it is not a shape readily felt by the user's fingers, and it is not an inexpensive small separate retrofit item.

Other devices include Gatlin (U.S. Pat. No. 4,709,925), Hartmeister (U.S. Pat. No. 3,245,686), Foster (U.S. Pat. No. 4,981,297), Henry (U.S. Pat. No. 3,376,038), and Rees (U.S. Pat. No. 1,213,014) are still more remote from the present invention, for the reasons discussed below.

SUMMARY OF THE INVENTION

Accordingly, it is one object of the present invention to provide a safety device for retrofitting on a handle of a golf club, and a method for retrofitting it thereon.

The object is accomplished, at least in part, by an anti-skid golfing apparatus for retrofitting on or incorporated in a handle of a golf club for preventing it from sliding off a golfer's hand when the golf club is swung. The anti-skid apparatus includes a frustoconical end portion with a noticeable diverging bevel or slanting enlargement of the grip diameter against which the golfer's little finger seats comfortably and reassuringly.

For retrofit installation, this tapered enlarged end portion may be a separate member molded of a rubber anti-skid material suitable for expanding to slide axially over an end of the handle of the golf club and then contracting to hold the frustoconical member thereon, having an inner cylindrical anti-skid surface for frictionally engaging the end of the handle and preventing the frustoconical member from sliding off the end of the handle, and having an outer frustoconical anti-skid surface for frictionally engaging the golfer's hand and preventing the golf club from sliding out of the golfer's hand when the golf club is swung.

This object is also accomplished, at least in part, by a unique method for retrofitting the anti-skid golfing apparatus on the end of the handle of the golf club.

Other objects and advantages of the present invention will become apparent to those skilled in the art from the following detailed description of the invention when read in conjunction with the appended claims and drawings attached hereto.

BRIEF DESCRIPTION OF THE DRAWING

The drawing, not drawn to scale, includes.

DETAILED DESCRIPTION OF THE INVENTION

Figure 3:
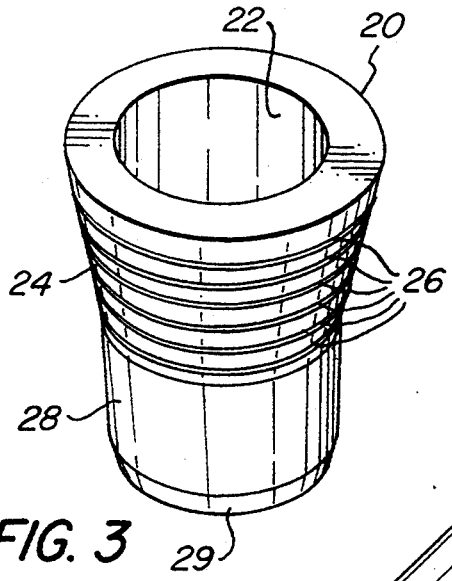
FIG. 3 showing a perspective view of another embodiment of an anti-skid golfing apparatus.
Figure 2:
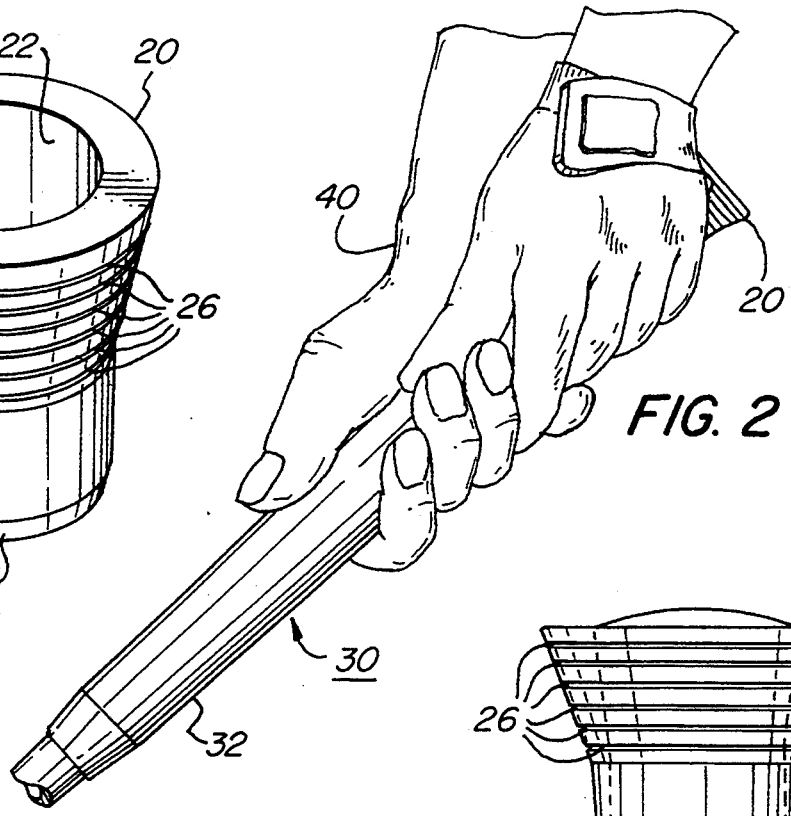
FIG. 2 showing a golfer gripping the golf club in FIG. 1.
Figure 4:
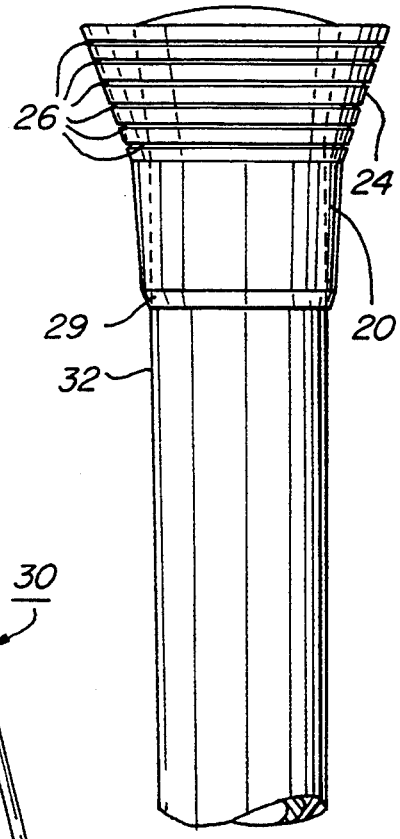
FIG. 4 showing a view of the anti-skid golfing apparatus on art end of a golf club.
Figure 5:
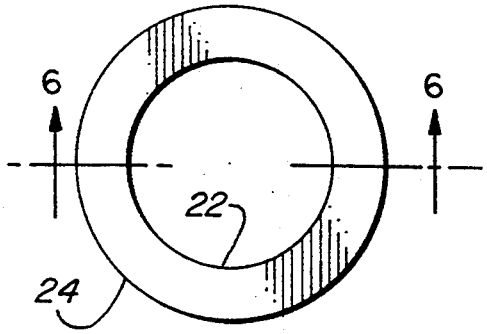
FIG. 5 showing a top down view of the anti-skid golfing apparatus in FIG. 3.
Figure 1:
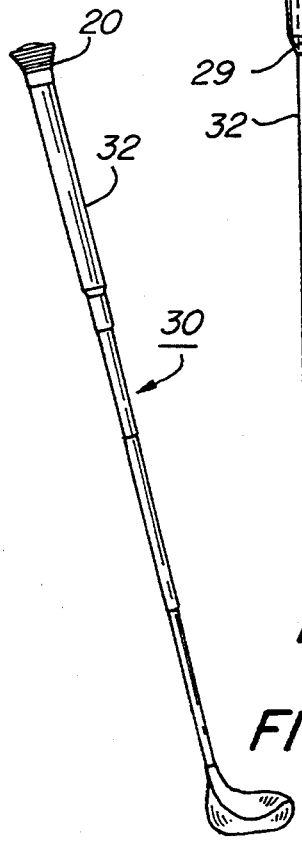
FIG. 1 showing a perspective view of one embodiment of an anti-skid golfing apparatus on a golf club.
Figure 6:
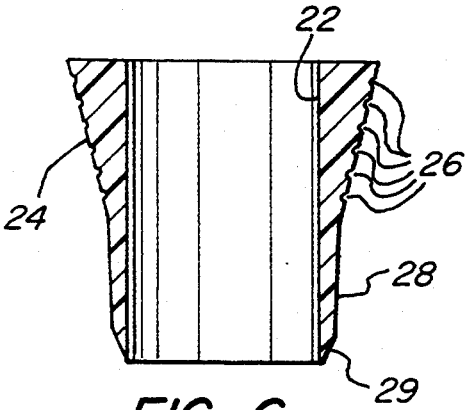
FIG. 6 showing a cross-sectional view of the anti-skid golfing apparatus in FIG. 3.
Figure 11:
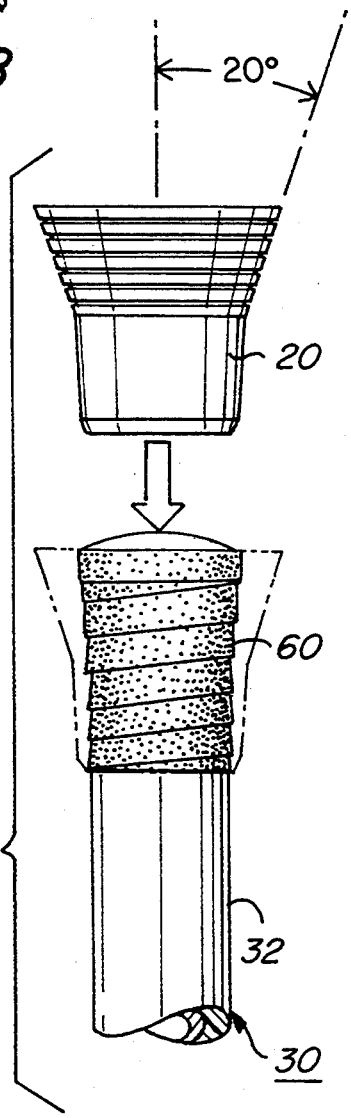

FIGS. 1 and 2 show an anti-skid apparatus 20 on a handle 32 of a golf club 30 or other apparatus to prevent it from sliding out of a user's hand 40 when being swung. The anti-skid apparatus 20 has an outer tapered anti-skid surface 24, which is frustoconical in shape, for frictionally engaging the user's hand 40 on the handle 32 and preventing it from sliding out of the user's hand 40. As shown in FIG. 11, the frustoconical surface 24 is angled at 20 degrees; however, within the spirit of the invention the frustoconical surface 24 can be angled anywhere in the range of 15 to 30 degrees, and preferably between 18 to 25 degrees.

In one embodiment, the anti-skid apparatus 20 is an integral part of the hand grip as shown for example in FIGS. 1 and 2. In an alternative embodiment, the anti-skid apparatus 20 is a separate component which is retrofit on to an end 34 of the handle 32 of the club 30 as for example shown in FIGS. 3–10.

The anti-skid apparatus 20 is made of a pliable anti-skid material and has an inner anti-skid surface 22 for frictionally engaging an end 34 of the handle 32 and preventing it from sliding off.

As shown, the handle 32 has a substantially cylindrical shape and the inner anti-skid surface 22 of the anti-skid apparatus 20 has a corresponding substantially cylindrical shape. However, if the handle had a substantially rectangular shape, like a tennis racket, then the inner anti-skid surface of the anti-skid apparatus 20 should have a corresponding substantially rectangular cylindrical shape, as well.

As shown, the outer frustoconical anti-skid surface 24 has circumferential grooves 26 arranged thereon.

The anti-skid apparatus 20 also has a lower circular cylindrical portion 28 integrally connected thereto, which has a tapered end 29 portion for providing a smooth transition where the anti-skid apparatus 20 meets the handle 32.

The outer tapered anti-skid surface 24 may also have protuberances (not shown) for frictionally engaging the user's hand 40.

Figure 7:
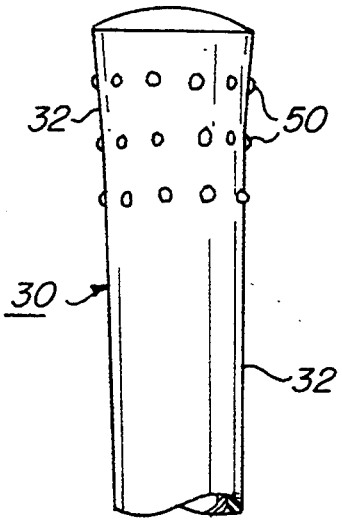
FIGS. 7–11 shows a method for retrofitting the anti-skid golfing apparatus on a handle of a golf club.
Figure 8:
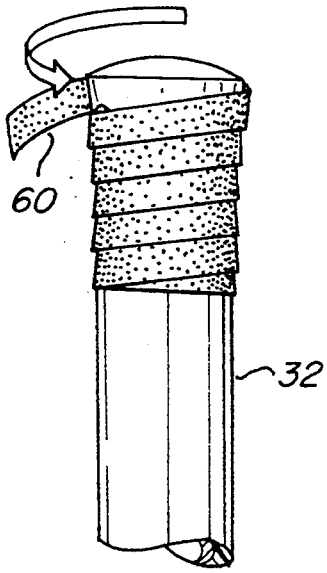
Figure 9:
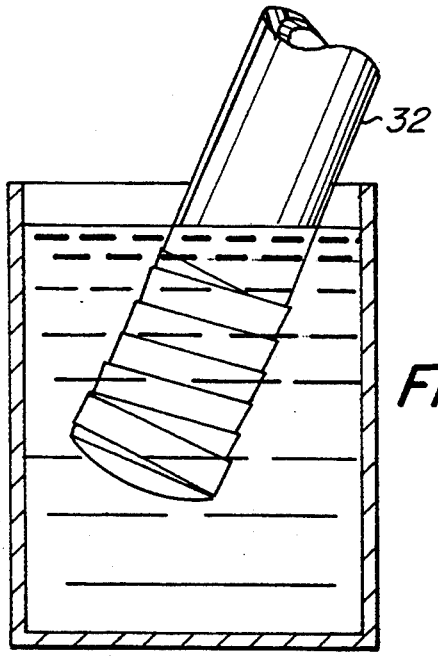
Figure 10:
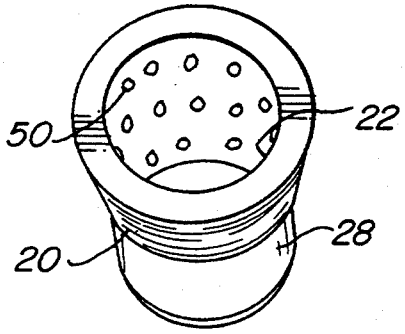

A method for retrofitting the anti-skid apparatus 20 is shown in FIGS. 7–11, including applying a super glue 50 to a surface of the handle 32 as shown in FIG. 7;

wrapping a tape 60 around the handle 32 before sliding the anti-skid apparatus 20 over the handle 32 for adhesively sticking to the handle 32 as shown in FIG. 8; applying a solution such as mineral spirits or paint thinner to the tape 60 as shown in FIG. 9; applying the super glue 50 to the inner cylindrical surface 22 of the anti-skid apparatus 20 as shown in FIG. 10; and sliding the anti-skid apparatus 20 over the handle 32 as shown in FIG. 11. The tape 60 can be single or double-sided. By retrofitting the anti-skid apparatus 20 on the handle 32 in this manner, a secure long lasting fit results.

Another method may also include first heating the anti-skid apparatus 20 to a first temperature above the so called "glass transition temperature" sufficient to soften the rubber anti-skid material and promote its elastic stretching deformation; sliding the pliable anti-skid apparatus 20 over the handle 32 of the golf club 30, and then cooling the anti-skid apparatus 20 to a normal ambient temperature.

It will thus be seen that the objects set forth above, and those made .apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An antiskid frustoconical rim for retrofitting over a butt of a golf club hand grip of a golf club to prevent it from sliding out of the golfer's hand when swung, comprising:

a short ring-like member having a smooth inner cylindrical surface for frictionally engaging a butt of a golf club hand grip, and having a smooth outer cylindrical surface for frictionally engaging a portion of the palm of the golfer's hand;

a frustoconical member being disposed on the rim-like member, having a conical surface flaring outwardly at an angle in a range of 15 to 30 degrees for frictionally engaging the ulnar border surface of the palm of the golfer's hand; and the antiskid frustoconical rim being an integral unit made of a pliable anti-skid material for flexibly expanding over the butt of the golf club hand grip, for flexibly contracting, squeezing and frictionally engaging the outer surface of the golf club hand grip, and for resisting relative movement between the golfer's hand and the golf club hand grip to prevent the golf club from sliding out of the golfer's hand when the golf club is swung.

2. An antiskid frustoconical rim according to claim 1, wherein the outer frustoconical surface is tapered in a subrange of 18 to 25 degrees.

3. An antiskid frustoconical rim according to claim 1, wherein the outer frustoconical surface is tapered at an angle of 20 degrees.

4. An antiskid frustoconical rim according to claim 1, wherein the outer frustoconical surface has protuberances for frictionally engaging the golfer's hand.

5. An antiskid frustoconical rim according to claim 1, wherein the antiskid retrofit device has a substantially rectangular shape for retrofitting over a handle of a tennis racket.

6. An antiskid frustoconical rim according to claim 1, wherein the antiskid frustoconical rim further includes a tapered end portion for providing a smooth comfortable transition between the short tubular member and the golf club hand grip.

7. An antiskid frustoconical rim according to claim 1, wherein the conical surface has circumferential gripping grooves concentrically arranged thereon for further frictionally engaging the ulnar border surface of the palm of the hand.

8. An antiskid frustoconical rim according to claim 1, wherein the circumferential gripping grooves are continuous.

9. A method for retrofitting an anti-skid frustoconical rim on a golf club handle, comprising the steps of:

providing an antiskid frustoconical rim being made of a pliable antiskid material for expanding to slide axially over a butt of the golf club handle and contracting to hold the antiskid frustoconical rim thereon, having an inner cylindrical antiskid surface for frictionally engaging the butt of the golf club handle and preventing the antiskid frustoconical rim from sliding off the butt of the golf club handle, and having conical surface flaring outwardly at an angle in a range of 15 to 30 degrees for frictionally engaging the ulnar border surface of the palm of the golfer's hand;

applying a super glue to a surface of the golf club handle;

wrapping a tape around the golf club handle to cover the super glue;

applying a solution such as mineral spirits or paint thinner to the tape around the golf club handle;

applying the super glue to the inner cylindrical antiskid surface of the antiskid frustoconical rim; and sliding the antiskid frustoconical rim over the tape so it adhesively sticks to the golf club handle.

10. A method according to claim 9, wherein the step of applying the tape includes applying a double-sided tape.

11. A method for retrofitting an antiskid frustoconical rim on a handle of a golf club, comprising the steps of:

providing the antiskid frustoconical rim being made of a pliable antiskid material for expanding to slide axially over an end of the handle of the golf club and contracting to hold the frustoconical member thereon, having an inner cylindrical antiskid surface for frictionally engaging the end of a handle of the golf club and presenting the frustoconical member from sliding off the end of the handle, and having conical surface flaring outwardly at an angle in a range of 15 to 30 degrees for frictionally engaging the ulnar border surface of the palm of the golfer's hand;

heating the antiskid frustoconical rim to a first temperature sufficient to soften the rubber antiskid material;

sliding the antiskid frustoconical rim over the handle of the golf club; and cooling the antiskid frustoconical rim to a normal ambient temperature to harden the rubber antiskid material.

* * * * *

UNITED STATES PATENT AND TRADEMARK OFFICE

CERTIFICATE OF CORRECTION

PATENT NO. : 5,423,536

DATED : June 13, 1995

INVENTOR(S) : R. Brown

It is certified that error appears in the above-indentified patent and that said Letters Patent is hereby corrected as shown below:

At column 1, line 25, please change "retro-fit" to --"retro-fit"--.

At column 2, line 16, please change "art" to --an--.

At column 4, line 53 (claim 11, line 9), please change "presenting" to --preventing--.

Signed and Sealed this

Twenty-sixth Day of September, 1995

*Attest:*

Bruce Lehman

BRUCE LEHMAN

*Attesting Officer*

*Commissioner of Patents and Trademarks*